United States Patent [19]

Miller et al.

[11] 4,008,588

[45] Feb. 22, 1977

[54] ROTARY PLUG CYLINDER LOCK CONSTRUCTION

[75] Inventors: Harry C. Miller, Rochester, N.Y.; Herman Edward Tickel, Jr., Centreville, Va.

[73] Assignees: H. Edward Tickel, Jr., Centreville, Va.; Harry C. Miller, Rochester, N.Y. ; part interest to each

[22] Filed: Apr. 28, 1976

[21] Appl. No.: 681,241

[52] U.S. Cl. ..... 70/366; 70/417; 70/419; 70/422

[51] Int. Cl.[2] ..... E05B 29/04; E05B 63/00

[58] Field of Search ..... 70/362, 365, 366, 376, 70/377, 416, 417, 419, 421, 422

[56] References Cited

UNITED STATES PATENTS

| | | | |
|---|---|---|---|
| 1,228,445 | 6/1917 | James | 70/417 X |
| 3,587,261 | 6/1971 | Berry | 70/422 |
| 3,848,442 | 11/1974 | Mertaner | 70/366 |

FOREIGN PATENTS OR APPLICATIONS

| | | | |
|---|---|---|---|
| 891,514 | 9/1953 | Germany | 70/366 |
| 115,202 | 10/1945 | Sweden | 70/366 |

*Primary Examiner*—Robert L. Wolfe
*Attorney, Agent, or Firm*—Mason, Fenwick & Lawrence

[57] ABSTRACT

A key operated rotary plug cylinder lock having rotary disc tumblers with a concentric cylindrical boss on one face of each disc tumbler projecting axially into internesting relation into a complemental cylindrical well or recess in the confronting face of the next adjacent disc tumbler. A lock-out pin mechanism to lock the plug against rotation when excessive rearward stress is exerted thereon, and a frangible lost motion coupling between the tumblers and the shell portion of the plug breakable upon excess torquing forces are also provided.

23 Claims, 7 Drawing Figures

ROTARY PLUG CYLINDER LOCK CONSTRUCTION

BACKGROUND AND OBJECTS OF THE INVENTION

The present invention relates in general to cylinder type key locks, and more particularly to key-operated rotary plug cylinder locks having rotary disc type tumblers and having special provisions for protecting the same against detection of the distinctive key contour or combination surface by picking probes or the like and otherwise enhancing protection of the lock against unauthorized entry.

One of the common types of key locks which have come into wide is the type known as a cylinder lock. Conventional cylinder locks normally comprise a relatively fixed cylinder forming the lock body or casing having a cylindrical bore opening through the front surface of the lock body which rotatably houses a rotating plug assembly. The rotating plug assembly has a key way or key slot opening through the front surface of the plug and extending over most of the axial length of the plug, as well as one or more resiliently urged tumblers formed of rotatable or slidable members which normally occupy positions confronting surfaces or traversing shear planes or interfacial planes preventing rotation of the plug relative to the cylinder. When a key of proper contour or combination surface is inserted in the key way or key opening in the plug, the contoured key surface aligns the resiliantly urged tumpler members in such a way that a parting line, either of the tumbler members or of some other locking member coactive with the tumbler members, is brought into coincidence with the interfacial plane or the arcuate peripheral surface of the plug, so that when all of the resiliantly urged tumblers are properly aligned by the contoured key surface, rotational motion imparted to the key permits the plug to turn through the normal motion involved in moving the lock from a locked to an unlocked condition.

Due to conditions which arise in the construction of the lock parts under normal manufacturing tolerances, it has been possible in cylinder locks which are not provided with special pick resistant features, to achieve unauthorized operation of the lock by such picking techniques as inserting a picking tool into the key way and exerting a torque on the plug so that with careful movement of the plug in selected directions, the resiliently urged tumbler first placed in compression by torquing the plug is aligned by the pick for clearance, at which point the plug rotates a minute degree to bring the next resiliently urged tumbler into a similar compressed condition and is aligned by the pick for clearance, and this succession of operation is repeated until all of the tumblers have been aligned to permit the plug to be rotated.

One of the most common types of cylinder locks is the pin tumbler type cylinder lock, wherein segmented tumbler pins formed of lower key engaging pin segments and upper drive pin segments have a line of separation between the segments which is normally displaced from the shear line of the plug but is positioned by the proper key so that the line of separation of all of the pin tumblers align with the plug shear line and permit rotation of the plug. Such pin tumbler type cylinder locks have been particularly susceptible to the above described types of picking techniques, and many attempts have been made to provide them with resistance to such picking operations. In some cases, the pin tumblers have been so constructed that the tampering by picking techniques with one of the tumbler pins automatically locks the remaining tumblers against further movement, or additional recesses have been provided in the outer cylindrical casing so that after a pin tumbler has been picked it re-engages in the absence of clearance of the remaining pin tumblers, or lock out devices have been provided so that attempts to pick one or more of the pin tumblers results in additional locking pins being activated to lock the plug against rotation even by authorized persons.

To increase resistance to picking by the techniques which are successful with pin tumbler type cylinder locks, cylinder locks of the rotary disc tumbler type have come into wider use. A popular type of rotary disc tumbler cylinder lock is the so-called Abloy lock, wherein a bank of peripherally gated rotary locking discs housed within a rotatable sleeve member have shaped center apertures which respond to a proper key surface to align the gates to permit radially inward movement of a locking bar which normally traverses the shear line between the rotary sleeve and an outer fixed cylinder casing. Such rotary disc tumbler type cylinder locks may be of the general type disclosed in U.S. Pat. No. 3,771,340 or 3,621,689, or 3,848,442, with or without related features of other patents obtained by the Finnish corporation Oy Wartsila Ab relating to the Abloy lock. Unauthorized detection of such rotary disc tumbler cylinder locks has been achieved, however, by techniques such as introducing a picking probe or similar tool into the key opening to interpose an offset shaped extension thereof between the faces of successive rotary disc tumblers and manipulating the probe to detect the position of the key engaging shoulder formation and/or of the peripheral gates of the respective tumblers and by observing the angular position of the probe externally of the lock determine therefrom the key combination or shaped surface contour of the key for that lock. Also, techniques of torquing the plug of such locks in a special manner or driving the center portion of the plug axially inwardly or drilling through the front of the lock case in alinement with the locking bar permitting removal of the locking bar have resulted in unauthorized penetration of the lock.

An object of the present invention is the provision of a novel rotary plug cylinder lock having rotary disc type tumblers constructed in a special manner to resist unauthorized detection of the key combination for the lock and resist unauthorized penetration of the lock.

Another object of the present invention is the provision of a novel rotary plug cylinder lock of the rotary disc tumbler type having the disc tumblers shaped to provide portions which internest in recessed formations in the adjacent tumbler disc and resist penetration of detecting probes into inter-tumbler spaces which would reveal the key combination for the lock.

Another object of the present invention is the provision of rotary plug cylinder locks of the type described in either of the two immediately preceeding paragraphs wherein disabling features are incorporated in the lock for preventing penetration or unauthorized operation of the lock when the plug or portions thereof are subjected to excessive stresses in certain directions.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figures 1, 2, 3:
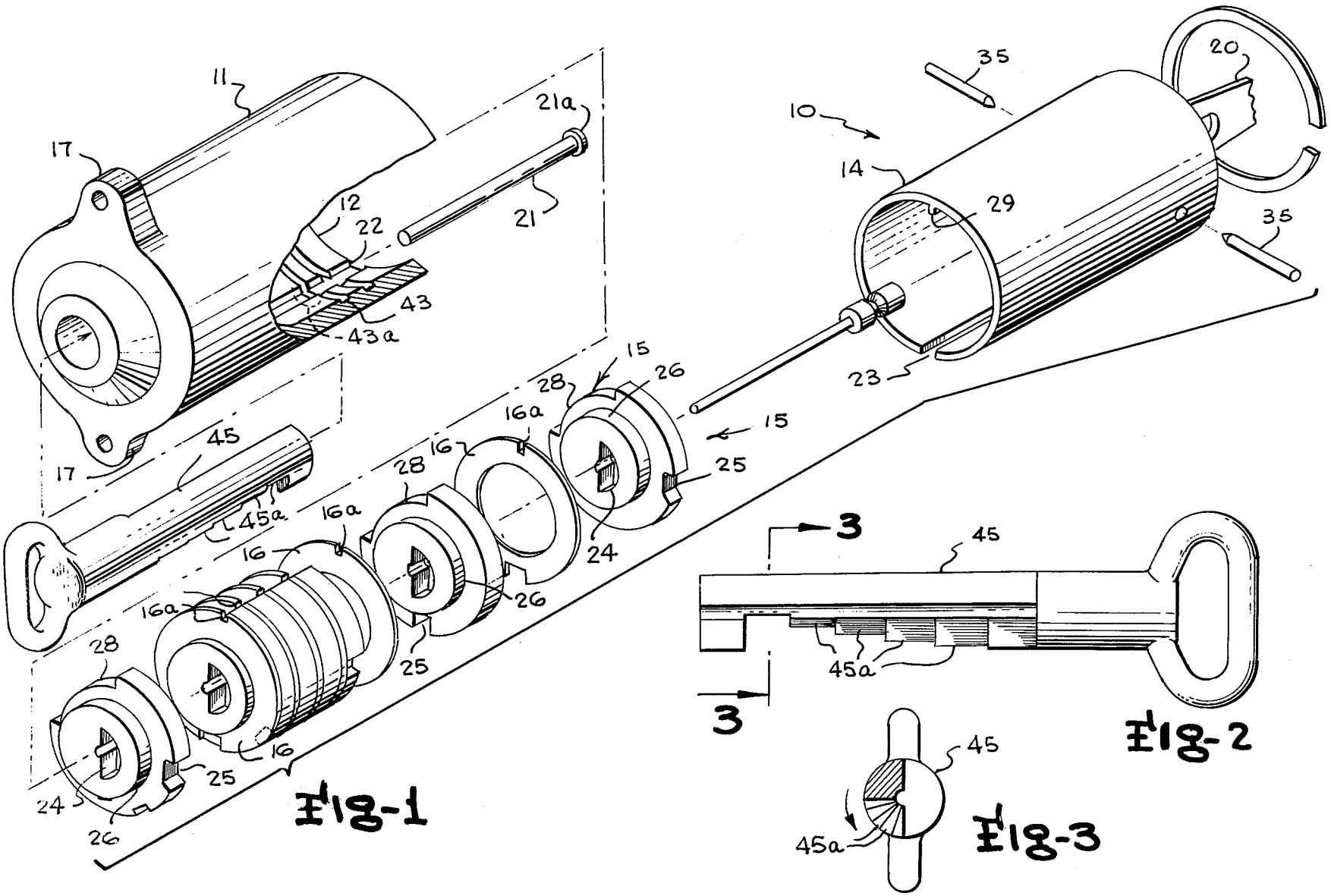
FIG. 1 is an exploding perspective view of a rotary plug cylinder lock embodying the present invention.
FIG. 2 is an elevation view of a typical key for unlocking the lock.
FIG. 3 is a section view taken along the line 3—3 of FIG. 2.

Referring to the drawings wherein like reference characters designate corresponding parts throughout the several figures, the cylinder lock of the present invention is indicated generally by the reference character 10 and comprises a generally cylindrical lock housing or casing 11 having a rearwardly opening cylindrical bore 12 housing a rotatable plug assembly 13. The rotatable plug assembly includes a cylindrical outer plug sleeve or shell member 14 which encloses a stack of rotatable locking discs or tumbler discs 15 arranged in a stacked array concentric with the center axis of the outer shell 14 of the plug. Annular washers or spacers may or may not be provided between successive tumbler discs, as desired, although washers or spacers 16 are provided in the disclosed embodiment having radial gates 16a opening outwardly at the outer periphery thereof to receive a rib, later described, on the inner surface of the outer shell 14 of the plug which prevents rotation of the washers.

The cylinder casing 11 is provided with the usual mounting enlargements, such as those indicated at 17 in the drawings, having screw holes for mounting the lock casing in the door or other body housing the lock assembly or may be provided with an enlarged cylindrical front flange and a suitable threaded mounting ring or clamping ring of conventional construction. The sleeve member 14 of the plug assembly has a cylindrical rear wall 18 sized to closely fit within the rearwardly opening bore 12 of the stationary cylindrical casing 11, and is provided with an integral boss or coupling formation 19 mounting the usual connecting bar 20 connected to a conventional latch bolt or the like to be locked and unlocked by the cylinder lock plug when the latter is rotated from locked to unlocked position upon insertion of a proper key.

In the normal condition of the lock without the proper key being inserted, the outer sleeve 14 of the plug assembly 13 is fixed against rotation relative to the lock cylinder casing 11 by means of a locking bar 21 extending parallel to the axis of the plug assembly and positioned so that it is partially located in an axial groove 22 in the inwardly facing surface of the cylinder casing 11 and partially in an axial slot 23 in the wall of the sleeve member 14, so as to span the shear line between them. The rotary locking discs 15 in the described embodiment may have a semicircular center opening 24 like the center openings in the locking disc of the earlier Oy Wartsila U.S. Pat. Nos. 3,621,689, or 3,835,677 or 3,681,956 to operate with one or more keys of semicircular cross section cut in accordance with a predetermined key coding to provide a combination surface having combination values at various incremental step angles, and the peripheral portions of the locking discs 15 are provided with one or more outwardly opening gates or recesses 25 to be radially aligned with the axial slot 23, axial groove 22 and locking bar 21. Only when the appropriate key is inserted in the key way defined by the center openings 24 and is rotated through an appropriate angle in the proper direction is the plug sleeve member 14 released as the tumbler gates 25 in the locking discs 15 are brought by the combination surface of the key into a position radially aligned with the locking bar. The aligned tumbler gates 25 in this position form a groove aligned with the locking bar 21 which receives the locking bar when a torque is transmitted to the plug sleeve 14 by turning of the key further in the same direction, a side wall of the axial groove 22 being shaped to cam the locking bar radially inwardly when the tumbler gates are aligned to receive it.

Figures 4, 5, 6, 7:
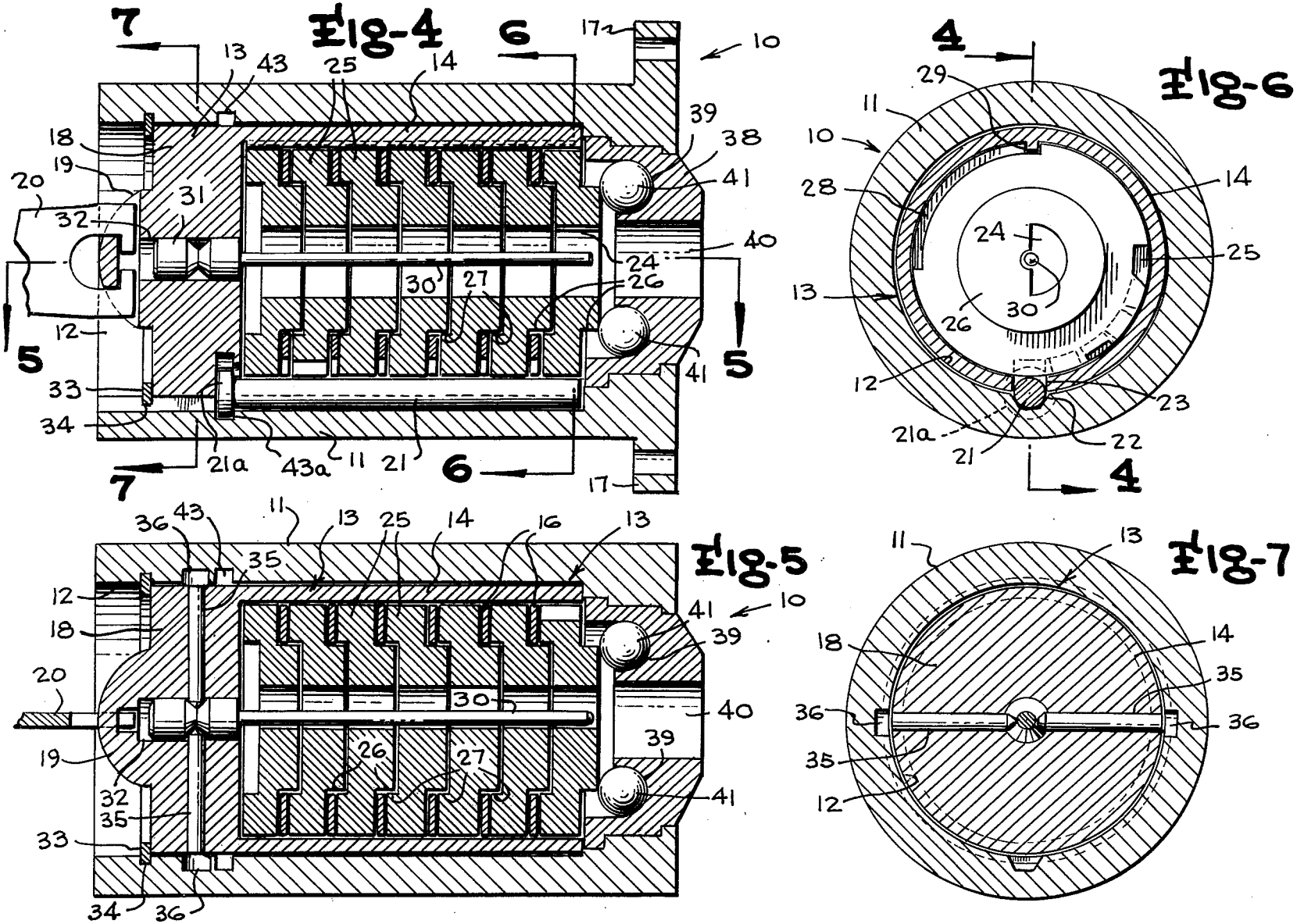
FIG. 4 is a vertical longitudinal section view taken along the line 4—4 of FIG. 6.
FIG. 5 is a horizontal longitudinal section view, taken along a section plane perpendicular to the section plane of FIG. 4.
FIGS. 6 and 7 are vertical transverse section views taken along the lines 6—6 and 7—7 of FIG. 4, respectively.

Most of the locking discs 15 are rotatable between a zero-position, shown in FIG. 6, in which the insertion and removal of the key is possible and an angularly displaced position, called a release position, in which the tumbler gate 15 is lined up to receive the locking bar 21, or is movable to two angular displaced released positions and is provided with two tumbler gates so that there are two angular positions at which the tumbler gates are properly aligned to receive the locking bar. The location of the tumbler gates 25 in the locking disc 15 determines the combination value of each locking disc, as this is the angle the the disc has to be turned from its zero-position to its releasing position by the key. The operating key, for example as shown at 45, is provided with a contoured or combination surface **45*a* for each locking disc so that when the key is turned, its combination surfaces 45*a* engage the straight surface of the center openings 24 of the locking discs and rotate each of the locking discs through the proper angle so that the tumbler gates 25 are all brought into releasing position aligned with the locking bar 21. In the embodiment shown, for example, the combination surfaces 45*a* may be cut at stepped angles spaced 18° apart, for example, providing combination surfaces on the key of 0°, 18°, 36°, 54°, 72° or 90°. At least one of the locking discs 15 having a turning angle of 0° may be non-rotatably fixed to the plug sleeve member 14 to transmit the torque from the key to the plug, and has a tumbler gate 25 which is constantly in releasing position aligned with the locking bar 21.**

In the embodiment illustrated in the drawings the locking discs or tumbler discs 15 are especially shaped to prevent insertion of a combination detecting probe into the keyway formed by the center openings 24 and extending a portion of the probe radially outwardly between an adjacent pair of the locking discs to the region of the tumbler gates 25 to feel circumferentially angular position of the tumbler gates, by shaping each tumbler disc to provide a forwardly projecting cylindrical boss or offset formation 26 sized to nest into a correspondingly shaped recess 27 in the confronting face of the adjacent locking disc 15. The forwardly projecting boss 26 and recess 27 are of greater axial length or dimension than the axial width of the space between successive adjacent locking discs, so that an offset or labyrinth type space is defined between each adjacent pair of locking discs, and the circumscribing cylindrical side wall of the internesting recess 27 in the rearwardly facing surface of each locking disc serves as a barrier against insertion of a probe portion radially in a plane perpendicular to the plug axis to the zone occupied by the tumbler gates 25. The annular washers or spacers 16, if provided between adjacent pairs of locking discs 15, have an inner diameter slightly larger than the diameter of the internesting boss 26 so as to surround the boss portion of the associated locking disc, as indicated in the drawings, and an outer diameter approximating the outer diameter of the discs 15, and have a gate in their outer periphery to receive the locking bar 21 in addition to gate 16*a*.

Also, instead of providing an outwardly projecting radial stop projection on each of the tumbler discs interfitting into a 90° sector recess in the plug sleeve member 14, as indicated in most of the previously cited Oy Wartsila patents, the peripheral portions of the locking discs are provided with a circumferentially elongated sector recess, for example a 90° sector recess, as indicated at 28, and the plug sleeve member 14 is provided with a thin radially inwardly projecting frangible rib 29 extending into the sector recesses 28 of the locking discs, deliberately formed to be sufficiently thin so that the rib 29 will shear if the locking discs are torqued with a force exceeding a preselected value before sufficient force is applied to shear the locking bar. This is provided to disable the lock against unauthorized penetration by torque forcing techniques, as shearing of the rib 29 permits all of the locking discs to freely rotate with the shearing tool as a pack, such that their gates remain out of alinement.

It will be noted from the drawings that the lock herein illustrated also includes a small diameter axially extending center pin member 30 concentric with the center axis of the keyway defined by the openings 24 in the stack of locking discs and extending forwardly through the full length of the keyway terminating at the front plane of the forwardmost locking disc 15, the substantially semicircular cross section key being appropriately recessed to accommodate the center pin member 30. The center pin member 30 includes an enlarged rearmost portion 31 positioned in a similarly sized opening 32 extending through the rear wall 18 of the plug sleeve member 14 and frictionally restrained therein so that it is movable rearwardly in the opening 32 only when a predetermined rearward driving force is applied to some part of the plug assembly 13, for example by rearward driving forces against the stack of locking discs attempting to drive the plug out of the casing 11, for example in an effort to overcome the usual O-ring 33 interfitted in the annular groove 34 therefore in the surface of the bore 12 rearwardly adjacent the rear wall 18 of the plug normally holding the plug in its bore 12. The enlargement 31 on the center pin member 30 serves as an actuating cam for one or more radial lockout pins, two of such lockout pins being indicated at 35, slidably supported and frictionally restrained in radial passages therefore in the rear wall 18 of the plug sleeve member 14 and alined with sockets 36 at appropriate circumferentially spaced positions in the inwardly facing surface of the cylindrical wall of the casing 11 surrounding the bore 12, into which the outer ends of the lockout pins 35 are driven by action of cam surface formations on the center pin enlargement 31 on the pins 35 when the center member is driven axially rearwardly.

Additional protection against drilling through the front of the lock assembly into the bore 12, for example, to gain access to the locking discs, is provided in the herein illustrated embodiment by the specially shaped entrance collar 38 at the entrance to the keyway defined by the key openings 24 of the locking discs. The entrance collar 38 has an external flange interfitting in appropriately shaped portions of the front wall of the casing 11 to support the collar 38 at the entrance to the keyway, and the collar is provided with an annular recess 39 inwardly surrounding the key entrance opening 40 in the collar, providing an annular inwardly opening channel which houses a circular array of hardened steel balls 41 arranged in approximate surface contact with each other to divert any drill bit which is attempted to be directed through the collar 38 to penetrate into the zone occupied by the locking discs. Preferably, the balls 41 are of an appropriate diameter so that the ring-like array of balls 41 covers the whole radial span of the locking discs from the diameter of the center opening 24 to the outer diameter of the locking discs.

To protect the lock against unauthorized forward removal of the locking bar by drilling a hole of the same or larger diameter than the locking bar through the front of the casing in parallel alignment with the locking bar axis to penetrate to the groove 22 and withdrawing the bar through the hole, an enlarged head 21*a* is provided on the rear end of the bar 21. The enlarged head 21*a* is integral with the remainder of the locking bar 21 and is normally positioned so that a portion thereof lies seated in a correspondingly shaped deepened sector 43*a* of an inwardly opening annular groove 34 in the cylindrical wall of the casing 11. The annular groove 43 is transversely aligned with the locking bar head 21*a* to accommodate rotation of the head portion 21*a* when the plug shell 14 and pack of locking discs 15 are rotated by a key after aligning the locking disc gates to receive the locking bar and the bar 21 shifts into the gates. The rear wall 13 of the plug assembly is also provided with a suitably shaped recess 43*b* to allow appropriate radial inward movement of the head 21*a* when the locking bar 21 shifts into the gates.

Instead of providing the ring-like circular array of drill diverting hardened steel balls, the entrance collar member 38 may be provided with a lattice pattern of drill resistant steel rods spanning the collar along chords paralleling two relatively perpendicular diameters of the entrance collar to interpose the drill diverting steel rods along the path one may attempt to advance a drill bit through the collar into the locking disc cavity.

Also, the locking discs, in accordance with usual practice, may be provided with a plurality of false gates, in addition to the true gates 25, such false gates being customarily of lesser radial depth than the true gate insufficient to accommodate enough inward movement of the locking bar 21 to release the plug assembly for rotation by the key, but located relative to the normal direction of unlocking adjustment of the locking discs so as to come into registry with the locking bar before the true gate is alined with the locking bar.

What is claimed is:

1. A cylinder lock of the rotatable disc tumbler type comprising a stationary cylinder casing, a rotatable plug assembly in said casing including an inner shell member rotatable in said casing and a plurality of locking disc tumblers encircled within said shell member and rotatable about a common axis therein, locking means normally restrained by said dsic tumblers at a position for locking said inner shell to the casing, the disc tumblers having gates alignable with and adapted to receive said locking means to permit rotation of the inner shell relative to the casing and said tumblers having key openings therein collectively defining a forwardly opening key way and shaped to be engaged and angularly moved by a key inserted therein for aligning the gates with the locking means, said locking disc tumblers each having a cylindrical boss formation projecting axially of the plug assembly from a first face thereof in a first direction and having a cylindrical recess in the opposite face thereof conforming in size and shape to said boss, said disc tumblers being arranged in an internesting stacked array with said boss formation received in nested relation in the recess of an immediately adjacent tumbler and said boss formations each having an axial extent greater than the space between adjacent disc tumblers in the stacked array whereby a barrier is formed across each intertumbler space at a location radially outwardly encircling the key way to prevent insertion of picking tool portions between tumblers from the key way into the gate regions thereof.

2. A cylinder lock as defined in claim 1 wherein said disc tumblers are generally circular plate-like discs having a front face and a rear face each having a flat circular center portion lying in a first transverse plane encircled by a flat annular outer rim portion lying in a second transverse plane offset axially of the tumbler from and paralleling the first transverse plane.

3. A cylinder lock as defined in claim 1 wherein said disc tumblers are generally circular plate-like discs having a front face and a rear face each having a flat circular center portion lying in a first transverse plane encircled by a flat annular outer rim portion lying in a second transverse plane offset axially of the tumbler from and paralleling the first transverse plane by a distance approximating the thickness of the tumbler.

4. A cylinder lock as defined in claim 1, wherein a cylindrical shoulder is provided by the side of said boss formation and of said recess spanning an axial distance at least as great as the space between adjacent tumblers and located radially outwardly of the key way and inwardly of the gate zone of the tumblers.

5. A cylinder lock as defined in claim 2, wherein a cylindrical shoulder is provided by the side of said boss formation and of said recess spanning an axial distance at least as great as the space between adjacent tumblers and located radially outwardly of the key way and inwardly of the gate zone of the tumblers.

6. A cylinder lock as defined in claim 3, wherein a cylindrical shoulder is provided by the side of said boss formation and of said recess spanning an axial distance at least as great as the space between adjacent tumblers and located radially outwardly of the key way and inwardly of the gate zone of the tumblers.

7. A combination lock as defined in claim 1, wherein said disc tumblers each have a circumferentially elongated relieved sector in the periphery thereof receiving a rib formation axially spanning the stack of tumblers and projecting radially inwardly from said inner shell to align the key openings of the tumblers proper positions for insertion and withdrawal of a key relative to the key way, said rib formation being a thin frangible member designed to be sheared from the inner shell when torque forces exceeding a predetermined threshold value are applied to the tumblers.

8. A combination lock as defined in claim 3, wherein said disc tumblers each have a circumferentially elongated relieved sector in the periphery thereof receiving a rib formation axially spanning the stack of tumblers and projecting radially inwardly from said inner shell to align the key openings of the tumblers proper positions for insertion and withdrawal of a key relative to the key way, said rib formation being a thin frangible member designed to be sheared from the inner shell when torque forces exceeding a predetermined threshold value are applied to the tumblers.

9. A combination lock as defined in claim 4, wherein said disc tumblers each have a circumferentially elongated relieved sector in the periphery thereof receiving a rib formation axially spanning the stack of tumblers and projecting radially inwardly from said inner shell to align the key openings of the tumblers proper positions for insertion and withdrawal of a key relative to the key way, said rib formation being a thin frangible member designed to be sheared from the inner shell when torque forces exceeding a predetermined threshold value are applied to the tumblers.

10. A combination lock as defined in claim 6, wherein said disc tumblers each have a circumferentially elongated relieved sector in the periphery thereof receiving a rib formation axially spanning the stack of tumblers and projecting radially inwardly from said inner shell to align the key openings of the tumblers proper positions for insertion and withdrawal of a key relative to the key way, said rib formation being a thin frangible member designed to be sheared from the inner shell when torque forces exceeding a predetermined threshold value are applied to the tumblers.

11. A cylinder lock of the rotatable disc tumbler type comprising a stationary cylinder casing, a rotatable plug asembly in said casing including an inner shell member rotatable in said casing and a plurality of locking disc tumblers encircled within said shell member and rotatable about a common axis therein, locking means normally restrained by said disc tumblers at a position for locking said inner shell to the casing, the disc tumblers having gate recesses alignable with and adapted to receive said locking means to permit rotation of the inner shell relative to the casing and said tumblers having key openings therein collectively defining a forwardly opening key way and shaped to be engaged and angularly moved by a key inserted therein for aligning the gate recesses with the locking means, said disc tumblers each having a circumferentially elongated relieved sector in the periphery thereof receiving a rib formation axially spanning the stack of tumblers and projecting radially inwardly from said inner shell to align the key openings of the tumblers to proper positions for insertion and withdrawal of a key relative to the key way, said rib formation being a thin frangible member designed to be sheared from the inner shell when torque forces exceeding a predetermined threshold value are applied to the tumblers.

12. A cylinder lock as defined in claim 1, wherein said inner shell includes a rear wall transversely spanning the shell having a pair of radial guide passages opening through the outer periphery thereof housing normally retracted elongated slidable lock-out pins therein, said casing having sockets located to receive ends of said lock-out pins when displaced outwardly from their retracted position, a center pin member extending from said rear wall forwardly through the length of the key way having cam formations confronting said lock-out pins for forcing the pins radially outwardly into said sockets when rearward driving forces exceeding a predetermined value are applied to the center pin member for locking the plug assembly against rearward dislodgement from the casing.

13. A cylinder lock as defined in claim 3, wherein said inner shell includes a rear wall transversely spanning the shell having a pair of radial guide passages opening through the outer periphery thereof housing normally retracted elongated slidable lock-out pins therein, said casing having sockets located to receive ends of said lock-out pins when displaced outwardly from their retracted position, a center pin member extending from said rear wall forwardly through the length of the key way having cam formations confronting said lock-out pins for forcing the pins radially outwardly into said sockets when rearward driving forces exceeding a predetermined value are applied to the center pin members for locking the plug assembly against rearward dislodgement from the casing.

14. A cylinder lock as defined in claim 5, wherein said inner shell includes a rear wall transversely spanning the shell having a pair of radial guide passages opening through the outer periphery thereof housing normally retracted elongated slidable lock-out pins therein, said casing having sockets located to receive ends of said lock-out pins when displaced outwardly from their retracted position, a center pin member extending from said rear wall forwardly through the length of the key way having cam formations confronting said lock-out pins for forcing the pins radially outwardly into said sockets when rearward driving forces exceeding a predetermined value are applied to the center pin member for locking the plug assembly against rearward dislodgement from the casing.

15. A cylinder lock as defined in claim 7, wherein said inner shell includes a rear wall transversely spanning the shell having a pair of radial guide passages opening through the outer periphery thereof housing normally retracted elongated slidable lock-out pins therein, said casing having sockets located to receive ends of said lock-out pins when displaced outwardly from their retracted position, a center pin member extending from said rear wall forwardly through the length of the key way having cam formations confronting said lock-out pins for forcing the pins radially outwardly into said sockets when rearward driving forces exceeding a predetermined value are applied to the center pin members for locking the plug assembly against rearward dislodgement from the casing.

16. A cylinder lock as defined in claim 11, wherein said inner shell includes a rear wall transversely spanning the shell having a pair of radial guide passages opening through the outer periphery thereof housing normally retracted elongated slidable lock-out pins therein, said casing having sockets located to receive ends of said lock-out pins when displaced outwardly from their retracted position, a center pin member extending from said rear wall forwardly through the length of the key way having cam formations confronting said lock-out pins for forcing the pins radially outwardly into said sockets when rearward driving forces exceeding a predetermined value are applied to the center pin members for locking the plug assembly against rearward dislodgement from the casing.

17. A cylinder lock of the rotatable disc tumble type comprising a stationary cylinder casing, a rotatable plug assembly in said casing including an inner shell member rotatable in said casing and a plurality of locking disc tumblers encircled within said shell member and rotatable about a common axis therein, locking means normally restrained by said disc tumblers at a position for locking said inner shell to the casing, the disc tumblers having gate recesses alignable with and adapted to receive said locking means to permit rotation of the inner shell relative to the casing and said tumblers having key openings therein collectively defining a forwardly opening key way and shaped to be engaged and angularly moved by a key inserted therein for aligning the gate recesses with the locking means, said inner shell including a rear wall transversely spanning the shell having a pair of radial guide passages opening through the outer periphery thereof housing normally retracted elongated slidable lock-out pins therein, said casing having sockets located to receive ends of said lock-out pins when displaced outwardly from their retracted position, a center pin member extending from said rear wall forwardly through the length of the key way having cam formations confronting said lock-out pins for forcing the pins radially outwardly into said sockets when rearward driving forces exceeding a predetermined value are applied to the center pin member for locking the plug assembly against rearward dislodgement from the casing.

18. A cylinder lock as defined in claim 17, wherein said locking means comprises a locking bar member having an elongated rectilinear bar portion of uniform cross section spanning the plurality of disc tumblers and paralleling said common axis to be received in the gates of said locking disc tumblers and having at the rear end integral therewith an enlarged head protruding radially in all directions beyond the bar portion, and said shell member having a socket receiving part of said head in nested relation therein defining a rearward facing stop shoulder adjacent the nested head portion preventing forward axial movement of the locking bar member, and the shell member having an annular groove aligned transversely with said head for accommodating a portion of the head during rotation of the plug assembly when the locking bar portion is nested in said gates.

19. A cylinder lock as defined in claim 1, wherein said locking means comprises a locking bar member having an elongated rectilinear bar portion of uniform cross section spanning the plurality of disc tumblers and paralleling said common axis to be received in the gates of said locking disc tumblers and having at the rear end integral therewith an enlarged head protruding radially in all directions beyond the bar portion, and said shell member having a socket receiving part of said head in nested relation therein defining a rearward facing stop shoulder adjacent the nested head portion preventing forward axial movement of the locking bar member, and the shell member having an annular groove aligned transversely with said head for accommodating a portion of the head during rotation of the plug assembly.

20. A cylinder lock as defined in claim 11, wherein said locking means comprises a locking bar member having an elongated rectilinear bar portion of uniform cross section spanning the plurality of disc tumblers and paralleling said common axis to be received in the gates of said locking disc tumblers and having at the rear end integral therewith an enlarged head protruding radially in all directions beyond the bar portion, and said shell member having a socket receiving part of said head in nested relation therein defining a rearward facing stop shoulder adjacent the nested head portion preventing forward axial movement of the locking bar member, and the shell member having an annular groove aligned transversely with said head for accommodating a portion of the head during rotation of the plug assembly.

21. A cylinder lock of the rotatable disc tumbler type comprising a stationary cylinder casing, a rotatable plug assembly in said casing including an inner shell member rotatable in said casing and a plurality of locking disc tumblers encircled within said shell member and rotatable about a common axis therein, locking means normally restrained by said disc tumblers at a position for locking said inner shell to the casing, the disc tumblers having gates alignable with and adapted to receive said locking means to permit rotation of the inner shell relative to the casing and said tumblers having key openings therein collectively defining a forwardly opening key way and shaped to be engaged and angularly moved by a key inserted therein for aligning the gates with the locking means, and pick barrier means projecting across each intertumbler space between each adjacent pair of tumblers flanking such space including a formation defining a generally cylindrical barrier surface concentric with the common axis and projecting axially from one face to one of the tumblers of each adjacent pair in a first direction and the adjacent tumbler of the pair having a recess in the face thereof confronting said one face and shaped to receive the cylindrical barrier surface in nested relation therein, the barrier surface having an axial extent greater than the space between adjacent disc tumblers in the stacked array and being disposed at a location radially outwardly encircling the keyway to prevent insertion of picking tool portions between tumblers from the keyway into the gate regions thereof.

22. A cylinder lock as defined in claim 1, wherein said barrier surface provides a radially inwardly facing cylindrical shoulder spanning an axial distance at least as great as about twice the space between adjacent tumblers and located radially outwardly of the keyway and inwardly of the gate zone of the tumblers.

23. A cylinder lock as defined in claim 21, wherein said disc tumblers each have a circumferentially elongated relieved sector in the periphery thereof receiving a rib formation axially spanning the stack of tumblers and projecting radially inwardly from said inner shell to align the key openings of the tumblers in proper positions for insertion and withdrawal of a key relative to the keyway, said rib formation being a thin frangible member designed to be sheared from the inner shell when torque forces exceeding a predetermined threshold value are applied to the tumblers.

* * * * *